United States Patent [19]

Schmid

[11] Patent Number: 5,062,138

[45] Date of Patent: Oct. 29, 1991

[54] HEARING AID WITH BATTERY COMPARTMENT

[75] Inventor: Erich Schmid, Schwaig, Fed. Rep. of Germany

[73] Assignee: Siemens Aktiengesellschaft, Munich, Fed. Rep. of Germany

[21] Appl. No.: 494,940

[22] Filed: Mar. 14, 1990

Related U.S. Application Data

[63] Continuation of Ser. No. 249,286, Sep. 26, 1988, abandoned.

[30] Foreign Application Priority Data

Sep. 29, 1987 [DE] Fed. Rep. of Germany ... 8713088[U]

[51] Int. Cl.[5] ..... H04R 25/00

[52] U.S. Cl. ..... 381/68.7; 381/69; 381/69.2

[58] Field of Search ..... 381/68.7, 69, 69.1, 381/69.2

[56] References Cited

U.S. PATENT DOCUMENTS

| | | | |
|---|---|---|---|
| 3,031,537 | 4/1962 | Rose | 381/68.7 |
| 3,475,566 | 10/1969 | Bauer | 381/69.2 |
| 3,641,288 | 2/1972 | Lamp | 381/69.2 |
| 3,701,862 | 10/1972 | Vignini | 381/69.2 |
| 4,598,177 | 7/1986 | McGroarty et al. | 381/68.7 |
| 4,783,816 | 11/1988 | Büttner et al. | 381/68.7 |
| 4,815,138 | 3/1989 | Diethelm | 381/69.2 |

FOREIGN PATENT DOCUMENTS

| | | | |
|---|---|---|---|
| 256349 | 2/1988 | European Pat. Off. | 381/69 |
| 1114848 | 10/1961 | Fed. Rep. of Germany . | |
| 1161599 | 1/1964 | Fed. Rep. of Germany . | |
| 2503253 | 1/1979 | Fed. Rep. of Germany . | |
| 2219970 | 11/1982 | Fed. Rep. of Germany . | |
| 8428516.8 | 3/1986 | Fed. Rep. of Germany . | |
| 3624568 | 1/1988 | Fed. Rep. of Germany | 381/69.2 |
| 56-56099 | 5/1981 | Japan | 381/69.2 |
| 1153195 | 5/1969 | United Kingdom | 381/69.2 |

*Primary Examiner*—Jin F. Ng
*Assistant Examiner*—Jason Chan
*Attorney, Agent, or Firm*—Hill, Van Santen, Steadman & Simpson

[57] ABSTRACT

A hearing aid housing comprises at least two housing shells and a battery compartment that can be brought into different swiveled positions. In order to simplify the structuring of the hearing aid, all mounts of the battery compartment hinge as well as catch means for producing the various swiveled positions are inventively situated at one housing shell. This facilitates the observation of tolerances in the manufacture of the hearing aid. The battery compartment is also firmly seated at one housing shell and can not separate or wobble during further assembly of the hearing aid.

7 Claims, 1 Drawing Sheet

HEARING AID WITH BATTERY COMPARTMENT

This is a continuation of application Ser. No. 249,286, filed Sept. 26, 1988 now abandoned.

BACKGROUND OF THE INVENTION

The present invention is directed to a hearing aid to be worn behind the hear (BTE device) and composed of at least two housing shells, comprising a hinge formed by at least one male member of a housing shell and comprising allocated catch means and comprising a battery compartment pivotable around the hinge that can assume a plurality of swiveled positions with the assistance of the catch means.

The battery compartments of traditional BTE devices (see, for example, German patent AS25 03 253 or German utility model 84 28 516) are situated at the lower end of the hearing aid housing and are pivotably held by the housing. The battery compartments can be brought into at least two swiveled positions, whereby the first is a pivoted-in position in which a battery held in the compartment touches the contact springs with its pole surfaces, and whereby the second is a pivoted-out position wherein the battery can be removed and replaced. Latch means are provided at the housing in order to hold the battery compartment firmly in at least the first position. The housing is traditionally designed such that it comprises two housing shells, whereby the one comprises a pin forming the swiveling axis and the second housing shell comprises the latch means. This design is usually employed both in hearing aids whose housing shells are composed of two lateral shells as well as in hearing aids whose shells are separated into a front shell and into a back shell.

In this design, however, both shell halves are required in order to hold the battery compartment in a defined position. Manufacture must thereby be carried out with particularly great care so that the various mounts of the battery compartment, particularly the swiveling axis and the latch means, are arranged with greatest precision with reference to the battery compartment and are arranged fitting to one another. Even slight deviations from the minimum tolerances, namely, lead to the result that the battery compartment, for example, does not terminate precisely with the housing shells or wobbles slightly in one or more positions.

German patent 22 19 970 discloses a hearing aid housing composed of two lateral shells, whereby a hinge pin and catch means are arranged at one shell half. The afore-mentioned design outlay, however, is not eliminated in this case since the position of a plug-in hole for the hinge pin at the second shell half must nonetheless be precisely mated to the pin.

SUMMARY OF THE INVENTION

It is an object of the present invention to provide a hearing aid that enables a precisely positioned and optimally functioning battery compartment with less outlay than hitherto.

This object is inventively achieved by arranging the hinge and the catch means at the same housing shell, such that the hinge proceeds parallel to a transverse width of a parting line of the housing shells, in that the battery compartment comprises a longitudinal depression, in that the battery compartment is attached to the same housing shell; and in that the battery compartment has the longitudinal depression hooked into the hinge.

According to the invention, the battery compartment is held by only one housing shell and is held firm in the swiveled positions. Only tolerances between these two components of the hearing aid must thus still be taken into particular consideration. Since, however, the hinge and the catch means are arranged at one housing shell, the tolerances are relatively easy to maintain. This is particularly true when the housing shell, the hinge and the catch means are manufactured of one piece on the basis of traditional injection technology. Moreover, the construction of the apparatus is facilitated. After the attachment of the battery compartment to the housing shell, it is seated so firmly that it can no longer release or wobble during further assembly. Deriving therefrom is the possibility of checking the functionability of the battery compartment before the final assembly of the device.

After assembly, the battery compartment can no longer be separated from the housing without first taking the housing shells apart. It is therefore not possible to mistakenly dismantle the battery compartment, for example when changing batteries.

BRIEF DESCRIPTION OF THE DRAWINGS

Further advantages and details of the invention derive from the following description of an exemplary embodiment with reference to the drawings.

DESCRIPTION OF THE PREFERRED EMBODIMENTS

Figure 1:
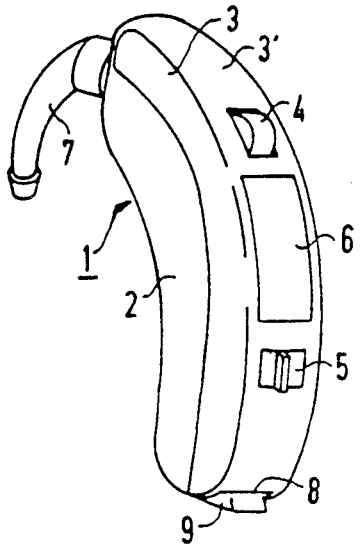
FIG. 1 is a perspective, outside view of a hearing aid to be worn behind the ear, the hearing aid embodying the principles of the present invention.

FIG. 1 shows a hearing aid 1 to be worn behind the ear. The hearing aid housing is composed of an inner shell 2 and an outer shell 3. Operating elements, particularly volume control 4 and switch 5 for switching between microphone and telephone coil project out of the outer shell 3 at a rear face 3' of the hearing aid 1. A pivotable flap 6 that covers an actuator group is also situated at the rear face 3'. A carrying hook 7 facilitates the positioning of the hearing aid 1 behind the ear of a hearing-impaired person and simultaneously conducts acoustic signals to the ear. A battery compartment 8 for a battery 8' is situated at the opposite end. The swiveling of the battery compartment 8 is facilitated by a finger grip 9 that projects somewhat at the end face of the hearing aid housing.

Figure 2:
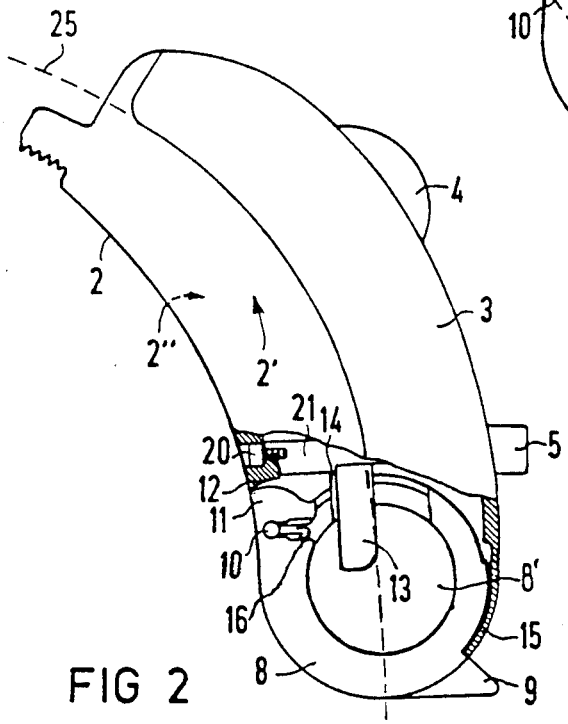
FIG. 2 is a side view of the inventively fashioned hearing aid comprising two housing shells and a battery compartment, shown in partial longitudinal section.
Figure 4:
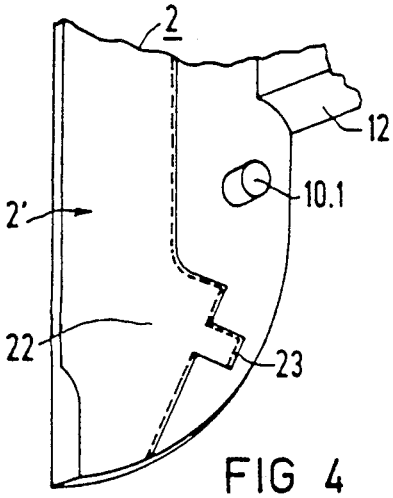
FIG. 4 is a perspective view of the hinge and of the catch means at the inside wall of the inner shell.

FIG. 2 shows a side view of the hearing aid, whereby the end comprising the battery compartment 8 is shown in longitudinal section. The battery compartment 8 is suspended at a hinge 10 that is formed by two male members, one of which illustrated at 10.1 (FIG. 4). The hinge 10 is arranged spaced from and parallel to a transverse width of a parting line 25. Every male member 10.1 is firmly joined to the inner shell 1 at lateral surfaces 2' and 2''. A bead 11 at the battery compartment 8 presses against a shell edge 12 at the inner shell 2. The shell edge 2 is arranged such with reference to the bead 11 that the bead 11 strikes against the edge 12 in all swiveled positions of the battery compartment 8. The battery compartment 8 is thereby firmly seated at the hinge.

When the battery compartment 8 is pivoted in, as shown in FIG. 2, the contact springs 13, 14 contact the poles of the battery 8'. In this position of the battery compartment 8, the device 1 can be switched on with the switch 5. The battery compartment 8 cannot be thrust farther into the device 1 beyond this swiveled position since the finger grip 9 strikes against an edge 15 of the outer shell 3. For changing batteries, the compartment 8 is pivoted out of the device 1 in the opposite direction.

Figure 3:
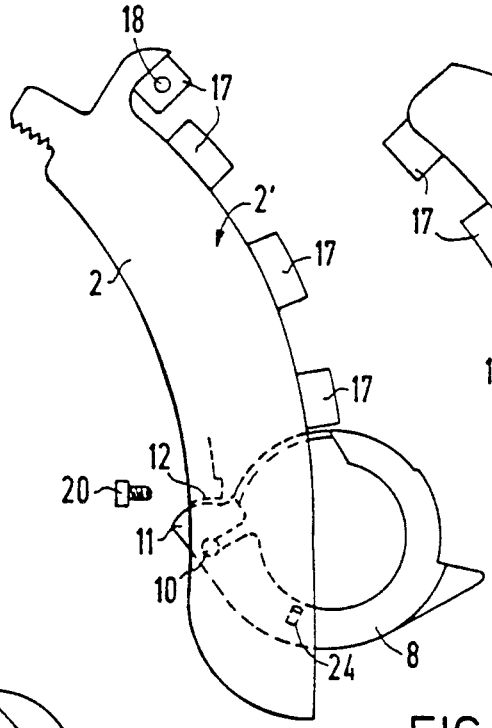
FIG. 3 is a side view of the hearing aid of FIG. 2 shown in an exploded view from which the assembly process of the housing may be seen.
Figure 3:
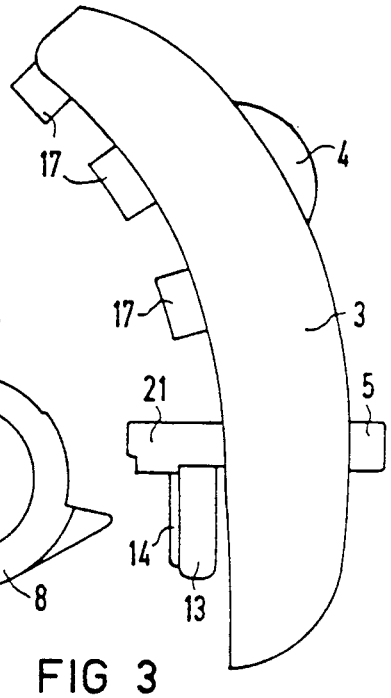

FIG. 3 shows the device 1 before assembly. For the mounting in the inner shell 2, the battery compartment 8 is positioned such that the two uniform male members or journals 10.1 lie at the open beginning of the longitudinal depression 16. The longitudinal depression, which is limited in longitudinal direction by the open beginning and the closed end, has its closed end closer to an outer contour of the battery compartment. The longitudinal direction of the longitudinal depression is different from a direction radiating from the center of the battery compartment. Subsequently, the battery compartment 8 is moved such that the two journals 10.1 slide into the closed end of the longitudinal depression 16. Upon such movement, the hinge 10 becomes operative and the battery compartment can be rotated about an axis between the upper mounting position illustrated in FIG. 3 to the lower (functioning) position shown in FIG. 2, this axis being formed by the journals 10.1 and the battery compartment 8 being hung from such journals. The outer shell 3 is placed onto the inner shell 2 such that tabs 17 engage into one another and a nub 18 at the lateral surface 2' of the inner shell 2 and a corresponding nub at the lateral surface 2'' snap into correspondingly fashioned depressions (not visible) at the outer shell 3. The shells 2, 3 are firmly connected to one another with screws 20 that grab into a web 21 at the outer shell 3. In order to again remove the battery compartment 8 from the housing 2, 3, the outer shell 3 would first have to be separated from the inner shell 2.

FIG. 4 shows a part of the lateral surface 2' from the inside. The male hinge pin member 10.1 projects out of the surface. The shell edge 12 may be seen above the male member 10.1. A hollowed-out region 22 that lies about 1 mm lower than the remaining surface of the inside is also situated at the surface. In particular, a cavity 23 belongs to this region. The cavity 23 provides the catch means of the hearing aid together with a projection 24 at the battery compartment (see FIG. 3). When the battery compartment 8 is pivoted adequately far into the housing 2, 3, the projection 24 snaps into the cavity 23. The battery compartment 8 is thus firmly closed and only moves when force is exerted on the finger grip 9. Thus the battery compartment is pivotable about the hinge in a plurality of swiveled positions, i.e., one where the catch means is engaged and others where the catch means is not engaged.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A hearing aid comprising a housing to be worn behind the ear and composed of at least two housing shells joined along a parting line having a transverse width comprising a width of said housing shells, a hinge formed by at least one male member of a first housing shell, catch means at least partially formed on said first housing shell and a battery compartment pivotable around said hinge in a plurality of swiveled positions and engageable with said catch means in one of said positions, said hinge being spaced from and parallel to said transverse width of said parting line of said housing shells; said battery compartment comprising a longitudinal depression having an opening facing toward a battery introducible into said battery compartment; said battery compartment being attached to said first housing shell when said hinge is hooked into said longitudinal depression of said battery compartment; a bead at said battery compartment being clamped between said hinge and an edge of said first housing shell facing toward said battery compartment in all swiveled positions of said compartment such that said battery compartment is secured at said hinge when said hearing aid is assembled.

2. A hearing aid according to claim 1, wherein said catch means comprise at least one projection and one cavity.

3. A hearing aid according to claim 2, wherein said projection is arranged at said battery compartment and said cavity is arranged at the inside of said first housing shell.

4. A hearing aid according to claim 1, wherein said first housing shell encompasses two lateral surfaces, each of which having a respective male hinge pin member forming said hinge.

5. A hearing aid according to claim 1, wherein said longitudinal depression, which is limited in longitudinal direction by an open beginning and a closed end, has its closed end closer to an outer contour of the battery compartment.

6. A hearing aid according to claim 5, wherein said longitudinal direction of the longitudinal depression is different from a direction radiating from the center of the battery compartment.

7. A hearing aid comprising a housing to be worn behind the ear comprising:

at least two housing shells joined along a parting line having a transverse width comprising a width of said housing shells;

a hinge formed by at least one male member formed on a first of said housing shells, said hinge oriented parallel to said transverse width of said parting line of said housing shells;

catch means at least partially formed on said first housing shell; and a battery compartment pivotable about said hinge and engageable with said catch means in one of a plurality of swiveled positions;

said battery compartment having a longitudinal depression, said longitudinal depression facing toward a battery introducible into said battery compartment, said battery compartment being attached to said first housing shell by means of said hinge hooking in said depression, said battery compartment further have a bead which is clamped between said hinge and an edge of said first housing shell facing toward said battery compartment in all swiveled positions of said compartment such that said battery compartment is secured at said hinge when said hearing aid is assembled.

* * * * *